US009428320B1

(12) United States Patent
Sutherland

(10) Patent No.: US 9,428,320 B1
(45) Date of Patent: Aug. 30, 2016

(54) FASTENER STORAGE AND ORGANIZER TRAY

(76) Inventor: Bill Sutherland, Sandy, UT (US)

( * ) Notice: Subject to any disclaimer, the term of this patent is extended or adjusted under 35 U.S.C. 154(b) by 0 days.

(21) Appl. No.: 12/381,367

(22) Filed: Mar. 10, 2009

Related U.S. Application Data

(60) Provisional application No. 61/035,366, filed on Mar. 10, 2008.

(51) Int. Cl.
*B65D 85/24* (2006.01)

(52) U.S. Cl.
CPC ..... *B65D 85/24* (2013.01)

(58) Field of Classification Search
CPC ..... B65D 85/24
USPC ..... 206/338, 342, 343, 345, 346, 372, 379, 206/443, 557–559, 561, 564, 556
See application file for complete search history.

(56) References Cited

U.S. PATENT DOCUMENTS

| | | | | | |
|---|---|---|---|---|---|
| 405,613 | A | * | 6/1889 | Sperry | 206/379 |
| 428,396 | A | | 5/1890 | Jennings | |
| 935,420 | A | * | 9/1909 | Smith | 206/564 |
| 2,792,934 | A | * | 5/1957 | Vittorio | 206/379 |
| 2,867,806 | A | * | 1/1959 | Ganton | 206/342 |
| 3,367,483 | A | * | 2/1968 | Studen | 206/379 |
| 3,499,525 | A | * | 3/1970 | Kanter | 206/379 |
| 3,642,123 | A | * | 2/1972 | Knox | 206/365 |
| 3,804,238 | A | * | 4/1974 | Howard | 206/372 |
| 3,923,152 | A | * | 12/1975 | Minneman | 206/372 |
| 4,151,912 | A | | 5/1979 | Harrold | |
| 4,413,731 | A | * | 11/1983 | Weideman | 206/379 |
| 4,807,747 | A | * | 2/1989 | Hadtke | 206/327 |
| 4,895,256 | A | | 1/1990 | Johnston | |
| 5,915,553 | A | * | 6/1999 | Brown et al. | 206/372 |
| 5,950,828 | A | | 9/1999 | Bal | |
| 6,112,896 | A | | 9/2000 | Bal | |
| 6,591,985 | B2 | | 7/2003 | Lai | |

* cited by examiner

*Primary Examiner* — Bryon Gehman
(74) *Attorney, Agent, or Firm* — Kenneth A. Roddy

(57) ABSTRACT

A fastener storage and organizer tray for storing, organizing, transporting headed fasteners, mating nuts, washers, screws, and other fasteners and fittings. The tray has a bottom wall bounded by upstanding peripheral side walls, and a plurality of individual compartments defined by upstanding lateral and transverse divider walls. At least one compartment has a generally rectangular raised platform with a horizontal top surface and a recessed trough at each end. The shanks of headed fasteners are supported on the platform surface with the heads and ends of the shanks in laterally adjacent alternating inverted side-by-side relation over the troughs at the ends of the platform. A fastener is easily removed by pressing down on the end of the shank to pivot it downward and raise the head of the fastener, and grasping the head of the fastener to remove it from the compartment, or vice versa.

15 Claims, 6 Drawing Sheets

FASTENER STORAGE AND ORGANIZER TRAY

CROSS REFERENCE TO RELATED APPLICATION

This application claims priority of U.S. Provisional Application Ser. No. 61/035,366, filed Mar. 10, 2008.

BACKGROUND OF THE INVENTION

1. Field of the Invention

This invention relates generally to storage containers and trays, and more particularly to a fastener storage and organizer tray for storing, organizing and transporting a supply of headed fasteners such as bolts of different bolt shank diameters, thread configuration and length, mating nuts, washers, screws, and other fasteners and fittings of different shapes and sizes, having a compartment configuration that facilitates easily grasping and removing an individual fastener from the compartment.

2. Background Art

It is necessary, particularly for maintenance and repair personnel, to maintain a supply of bolts of different bolt shank diameters, thread configuration and length, as well as mating fastening nuts, washers, screws, and other fasteners and fittings of many different shapes and sizes on hand for quickly and effectively repairing machinery and the like.

Various trays, carriers, and storage containers are known in the art, which typically are divided into a plurality of compartments of various sizes for containing such articles, and usually a number of the articles of a particular characteristics and size are kept loosely in individual compartments. However, they often become mixed together in a single container, which makes it extremely difficult and time consuming to locate a bolt of a desired shank diameter, thread configuration and length. It is also difficult and time consuming to grasp and remove an individual bolt or fastener from a number of loosely held articles contained in an individual compartment.

SUMMARY OF THE INVENTION

It is therefore an object of the present invention to provide a fastener storage tray for storing and transporting a supply of headed fasteners such as bolts of different shank diameters, thread configuration and length, mating nuts, washers, screws, and other fasteners and fittings of different shapes and sizes.

It is another object of this invention to provide a fastener storage tray for storing and transporting a supply of headed fasteners such as bolts of different shank diameters, thread configuration and length, mating nuts, washers, screws, and other fasteners and fittings of different shapes and sizes wherein such articles are readily accessible.

Another object of this invention is to provide a fastener storage tray for storing and transporting a supply of headed fasteners such as bolts of different shank diameters, thread configuration and length, mating nuts, washers, and other fasteners and fittings of different shapes and sizes wherein the tray has a compartment configuration that facilitates easily grasping and removing an individual fastener from the compartment.

A further object of this invention is to provide a fastener storage tray as characterized above which enables the various articles to be stored in predetermined locations within the container so as to be readily identifiable and accessible as to size, shape or other characteristics.

A still further object of this invention is to provide a fastener storage tray as characterized above which is simple in construction, inexpensive to manufacture, and rugged and dependable in operation.

Other objects of the invention will become apparent from time to time throughout the specification and claims as hereinafter related.

The present invention overcomes the aforementioned problems and is distinguished over the prior art in general by the present fastener storage tray for storing, transporting and easily accessing headed fasteners such as bolts of different bolt shank diameters, thread configuration and length, mating nuts, washers, screws, and other fasteners and fittings of different shapes and sizes. The tray has a bottom wall bounded by upstanding peripheral side walls, and a plurality of individual compartments of different lengths and widths defined by upstanding lateral and transverse divider walls. At least one compartment has a generally rectangular raised platform with a top surface disposed horizontally in a plane a distance below the top end of the peripheral end walls and divider walls and a generally rectangular recessed transverse trough at each end. Some compartments may also have a recessed trough along either side of the raised platform divided by a transverse divider wall into two longitudinal troughs. A number of headed fasteners are supported on the platform top surface in laterally adjacent alternating inverted side-by-side relation with the shank of each fastener supported on the platform, the head received in the transverse trough at one end of the platform and the end of its shank extending over the transverse trough at the opposed end or over the longitudinal troughs. A fastener is easily removed by pressing down on the end of the shank to pivot it downward into the recessed trough and raise the head of the fastener above the compartment walls, and then grasping the head of the fastener to remove it from the compartment, or vice versa.

DESCRIPTION OF THE PREFERRED EMBODIMENT

Figure 1:
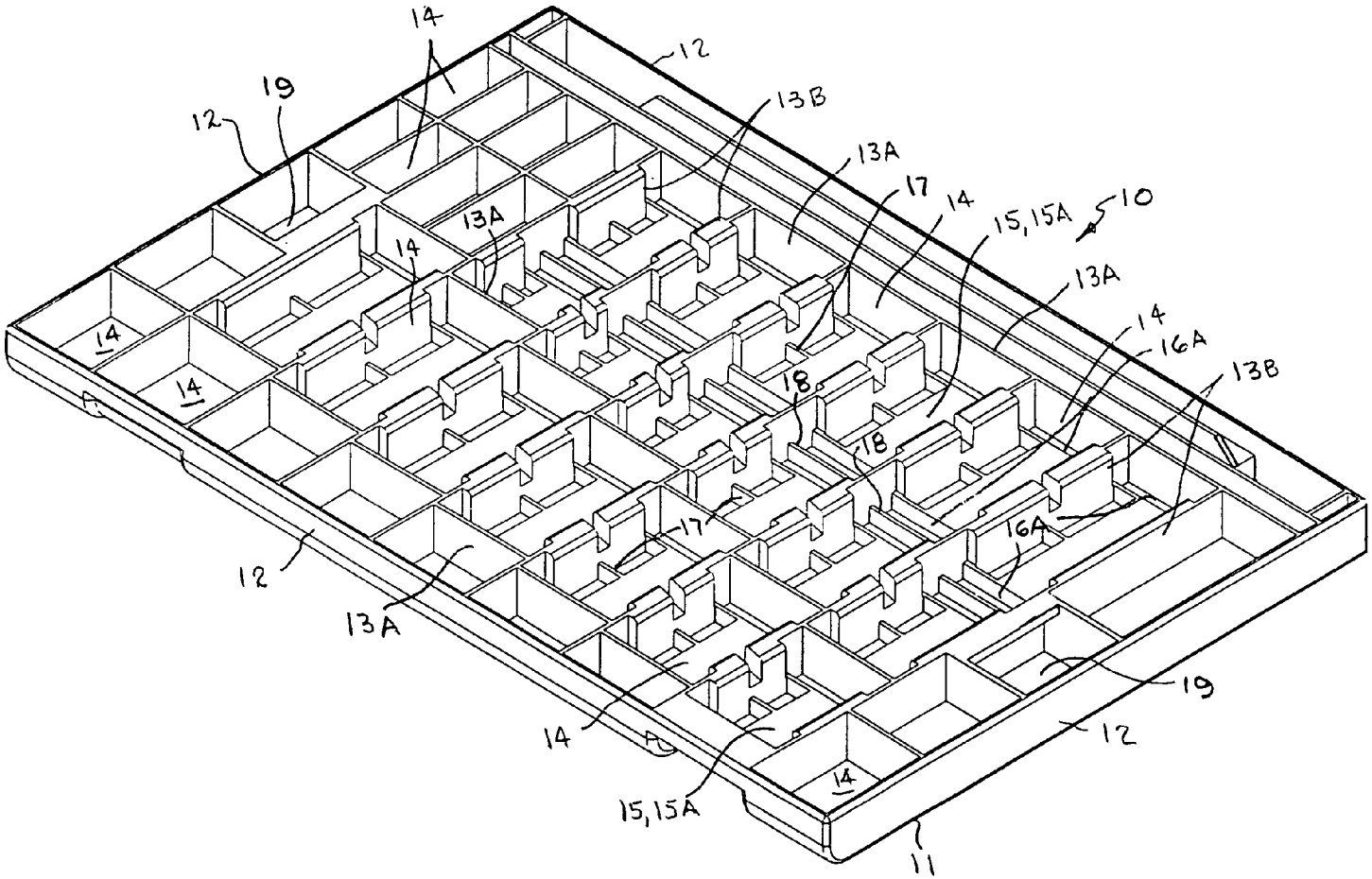
FIG. 1 is a perspective view of the fastener storage tray in accordance with the present invention, as seen from the top.
Figure 2:
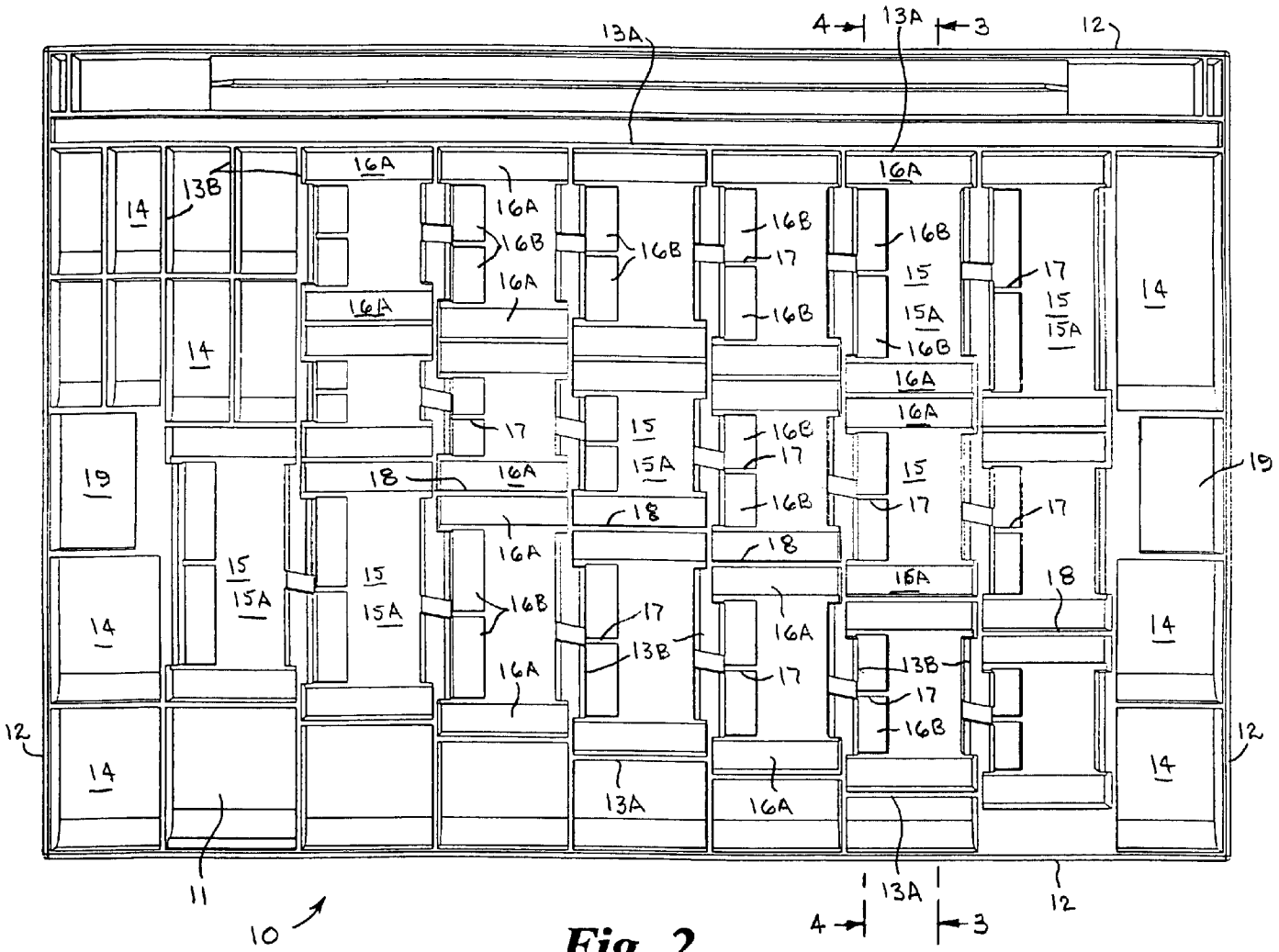
FIG. 2 is a top plan view of the fastener storage tray.
Figure 3:
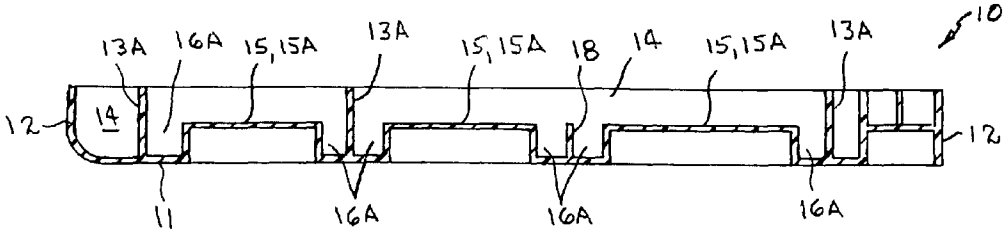
FIG. 3 is a cross sectional view of the fastener storage tray, taken along line 3-3 of FIG. 2.
Figure 4:
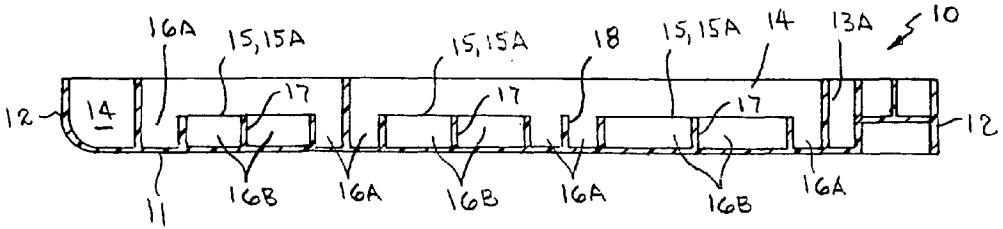
FIG. 4 is a cross sectional view of the fastener storage tray, taken along line 4-4 of FIG. 2.

Referring to the drawings by numerals of reference, there is shown in FIGS. 1-6, a preferred fastener storage tray 10 for storing and transporting a supply of fasteners such as bolts of different bolt shank diameters, thread configuration and length, mating nuts, washers, screws, and other fasteners and fittings of different shapes and sizes.

The tray 10 is a generally rectangular box-like configuration formed of suitable plastic material having a bottom wall 11 bounded by upstanding peripheral side walls 12, with upstanding transverse and lateral divider walls 13A and 13B, extending upwardly from the bottom wall and terminating in a plane approximately flush with the top end of the peripheral end walls, which divide the tray into a plurality of storage compartments of different lengths and widths.

A number of the individual compartments 14 of the tray 10 are each provided with a generally rectangular raised platform 15 having a top surface 15A spaced a distance inwardly from two opposed transverse divider walls 13A at opposed ends to define a generally rectangular recess or transverse trough 16A at two opposed ends of the raised platform. The generally rectangular raised platform 15 is also spaced a distance inwardly from a lateral divider wall 13B on at least one side to define a recessed lateral trough along either side of the raised platform which is divided by a shorter transverse divider wall 17 into two longitudinal troughs 16B. A shorter transverse divider wall 18 may also be provided between the opposed facing ends of two adjacent spaced raised platforms 15 to define a generally rectangular recess or transverse trough 16A between the opposed facing ends of the adjacent raised platforms. The top surface 15A of the rectangular raised platform 15 is disposed horizontally in a plane a distance below the top end of the peripheral end walls 12 and transverse and lateral divider walls 13A and 13B. The shorter transverse divider walls 17, 18 extend upwardly from the bottom wall 11 of the tray 10 and terminate in a plane approximately flush with the top surfaces 15A of the raised platforms 15.

The opposed lateral divider walls 13A and 13B are spaced a predetermined distance apart so as to accommodate the combined diameters of the shank portions of a number of adjacent inverted side-by-side headed fasteners F, such as bolts or cap screws, of particular standard sizes.

Figure 6:
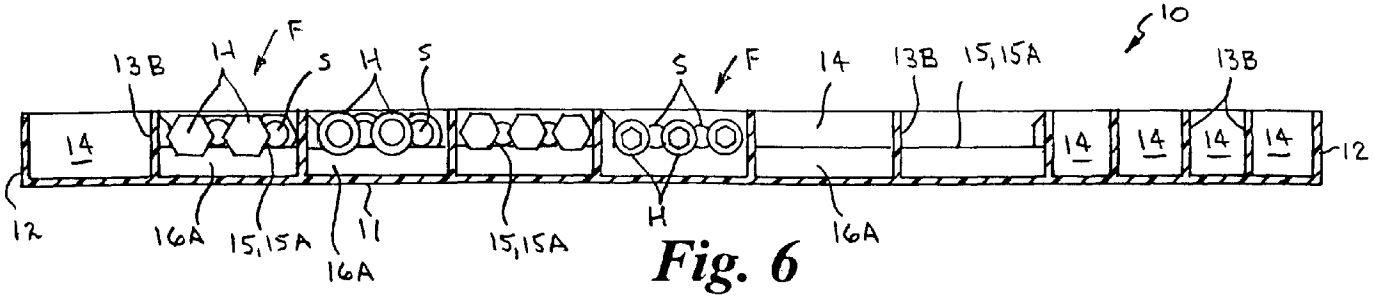
FIG. 6 is a cross sectional view of the fastener storage tray, taken along line 6-6 of FIG. 5, showing the laterally adjacent alternating inverted head and shank storage position of the fasteners, with the heads disposed in a recess at one end of the raised platform in the compartment.
Figure 5:
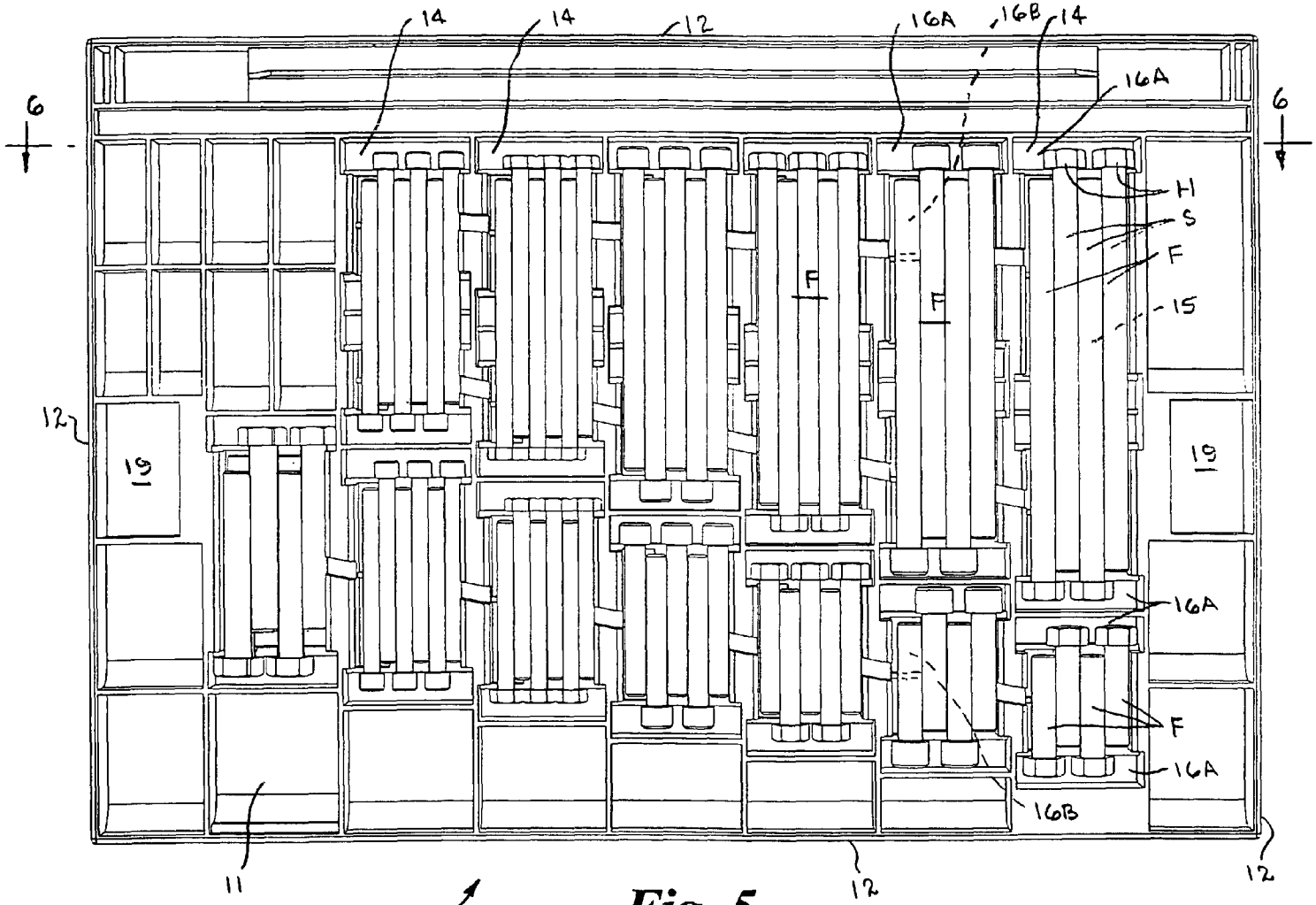
FIG. 5 is a top plan view of the fastener storage tray, showing a plurality of fasteners in various compartments.

For example, as best seen in FIGS. 5 and 6, a number of bolts and fasteners F are shown supported in several compartments 14. The shanks S of the bolts or fasteners F are supported on the raised platform 15 in laterally adjacent alternating inverted side-by-side relation with the head of each bolt or fastener received in the recess or transverse trough 16A at one end of the platform 15. The end of the shank S of at least one fastener extends over the lateral recess or longitudinal trough 16B at the side of the platform 15.

Figure 7:
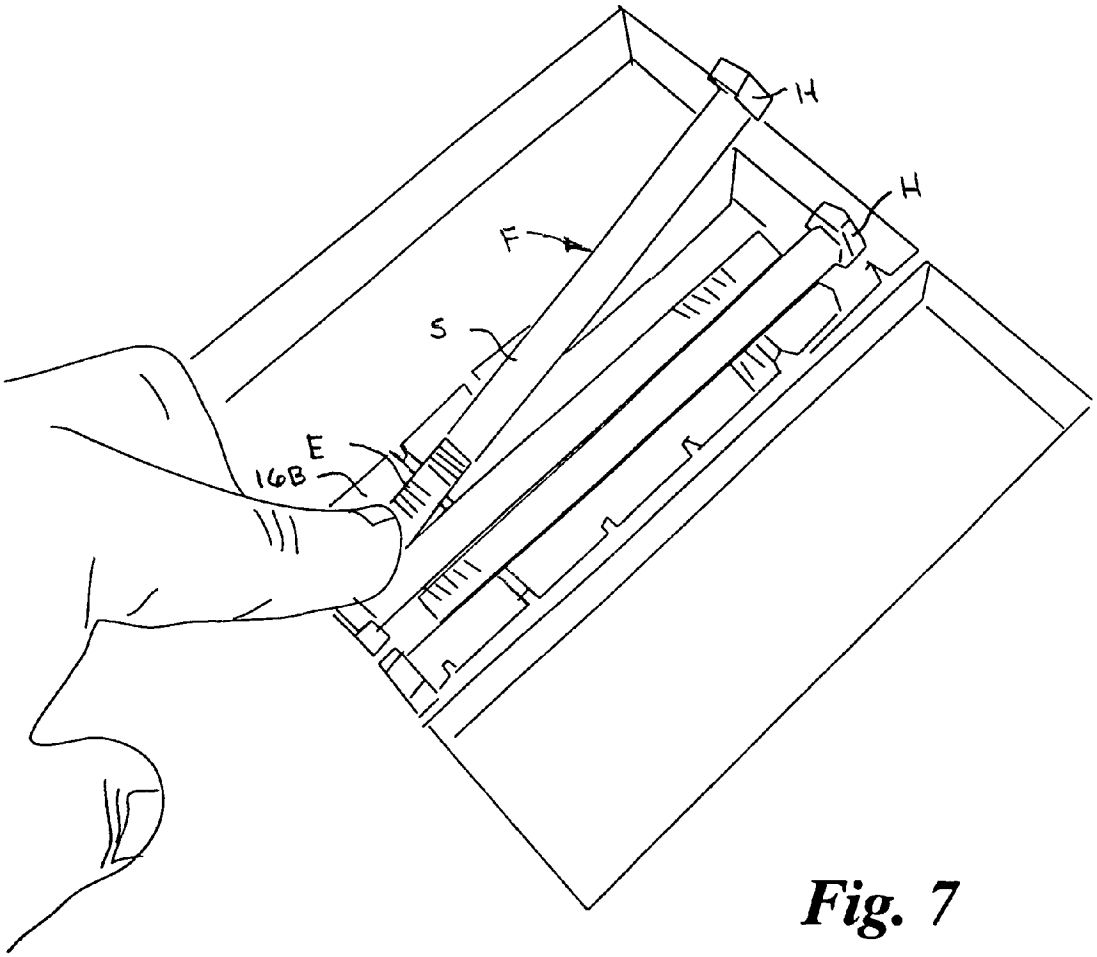
FIG. 7 is an illustration showing somewhat schematically, a user pressing down on a shank of a fastener to raise the head above the compartment to facilitate easily grasping and removing the fastener from the compartment.

As shown somewhat schematically in FIG. 7, a user may easily remove a desired fastener F by simply pressing down on the end E of the shank S of the fastener, which pivots it downward into the lateral recess or longitudinal trough 16B and raises the head H of the fastener above the compartment walls, and then grasping the head removing the fastener from the compartment.

It should be understood that desired fastener, which may or may or may not have the end of its shank extending over the lateral recess or longitudinal trough 16B at the side of the platform 15, may also be easily removed by pressing down on the head end of the fastener to pivot it downward into the recessed transverse trough 16A and raise the end of the shank above the compartment walls, and then grasping the shank of the fastener to remove it from the compartment.

It should also be understood that the length of the raised platform 15 may be correlated to the length of the shanks of the fasteners such that when the head of the fastener is received in the recess or trough 16 at one end of the platform, the end of its shank will extend a predetermined distance beyond the opposite end of the platform over the recess or transverse trough 16A at the opposite end of the platform to allow the shank end to pivot downward into the recess or trough.

The compartments 14 with platforms 15 and troughs 16 are sized to accommodate headed fasteners of different shank diameters, thread configuration and length. Other ones of the compartments may be of a conventional configuration not having platforms and troughs for accommodating mating nuts, washers, and other fasteners and fittings. A number of the trays may be stacked on top of another in a tool box or other container, of individual trays may be slidably supported in a cabinet.

In a preferred embodiment, the tray has a generally rectangular cutout 19 in the bottom wall at two opposed ends adjacent to the peripheral side wall to form a handle for lifting the tray or sliding it in and out of a cabinet.

Figure 8:
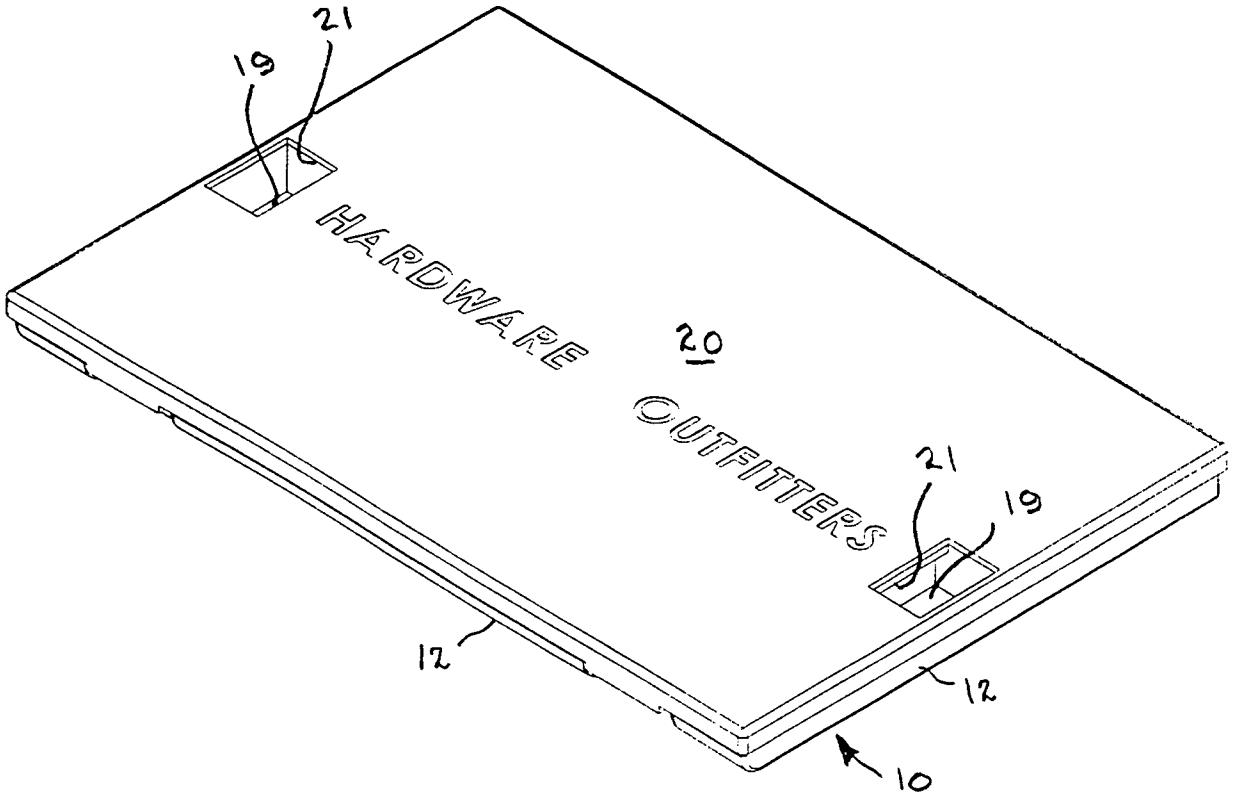
FIG. 8 is a perspective view of the fastener storage tray in accordance with the present invention, with the cover closed.

As shown in FIG. 8, the tray 10 of the present invention may also be provided with a hinged cover 20 having a conventional hinge and a latch mechanism. In a preferred embodiment, the cover 20 has a generally rectangular cutout 21 in its top wall at two opposed ends adjacent to the peripheral side wall which is aligned with the cutout 19 in the bottom wall at two opposed ends adjacent to the peripheral side wall of the tray 10 to jointly form a handle for lifting the tray or sliding it in and out of a cabinet.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A fastener storage and organizer tray for storing, organizing and transporting a supply of headed fasteners and bolts of different bolt shank diameters, thread configuration and length, mating nuts, washers, screws, and other fasteners and fittings of different shapes and sizes, comprising:

a generally rectangular tray having a bottom wall bounded by upstanding peripheral side walls, upstanding lateral and transverse divider walls extending upwardly from said bottom wall terminating in a plane approximately flush with a top end of said peripheral side walls dividing said tray into a plurality of individual storage compartments of different lengths and widths; and at least one of said storage compartments having at least one generally rectangular raised platform, each said raised platform having a top surface disposed horizontally in a plane a distance below top ends of said peripheral side walls and said divider walls, and said raised platform spaced a distance inwardly from two opposed said transverse divider walls defining a generally rectangular recessed transverse trough at each respective opposed end of each said raised platform; wherein shank portions of a number of headed fasteners disposed in laterally adjacent alternating inverted side-by-side relation are supported on said raised platform top surface with a portion of the heads of alternate headed fasteners disposed in one said transverse trough at one of said respective opposed ends of said raised platform.

2. The fastener storage and organizer tray according to claim 1, wherein each said raised platform top surface has a length correlated to the length of the shank portion of the headed fastener supported thereon such that when the head of a headed fastener is pressed downwardly into said recessed transverse trough at one end of said raised platform, the end of its shank portion will pivot upwardly above one of said divider walls at an opposed end of said raised platform to facilitate grasping the shank portion and removing the headed fastener from a respective one of said storage compartments.

3. The fastener storage and organizer tray according to claim 1, wherein each said raised platform is spaced inwardly a distance from two opposed said transverse divider walls a distance sufficient to support the shank portions of a number of headed fasteners on said top surface in laterally adjacent alternating inverted side-by-side relation with a portion of the heads of alternate headed fasteners disposed in a transverse trough at one of said opposed ends of said raised platform, and the end of their shank portions extending over said transverse trough at the opposed end of said raised platform.

4. The fastener storage and organizer tray according to claim 3, wherein each said raised platform top surface has a length correlated to the length of the shank portion of the headed fastener supported thereon such that when the end of the shank portion of a headed fastener is pressed downwardly into said recessed transverse trough at one end of said raised platform, the head of the headed fastener will pivot upwardly above one of said divider walls at an opposed end of said raised platform to facilitate grasping the head and removing the headed fastener from a respective one of said storage compartments.

5. The fastener storage and organizer tray according to claim 1, wherein each said raised platform has at least one side spaced inwardly a distance from at least one said lateral divider wall and between each said transverse trough at said respective opposed ends of said raised platform, and a shorter transverse divider wall extends transversely between said at least one side of said raised platform and said at least one lateral divider wall defining a pair of generally axially aligned rectangular recessed lateral troughs disposed along said at least one side of said raised platform, said shorter transverse divider wall extending upwardly from said bottom wall terminating in a plane approximately flush with said top surface of said raised platform; and the shank portion of at least one of said headed fasteners is supported on said shorter transverse divider wall with a portion of the head of said at least one headed fastener disposed in a said transverse trough at one of said opposed ends of said platform and the end of its shank portion extends over one of said recessed lateral troughs.

6. The fastener storage and organizer tray according to claim 5, wherein said recessed lateral troughs have a length correlated to the length of the shank portion of the headed fastener supported on said shorter transverse divider wall such that when the end of the shank portion of the headed fastener is pressed downwardly into one of said lateral troughs, the head of the headed fastener will pivot upwardly above one of said divider walls at an opposed end of said recessed lateral troughs to facilitate grasping the head and removing the headed fastener from a respective one of said storage compartments.

7. The fastener storage and organizer tray according to claim 1, wherein said at least one raised platform comprises at least two said raised platforms spaced a distance inwardly from two opposed said transverse divider walls in adjacent spaced end to end relation defining a first generally rectangular recessed transverse trough between said two opposed transverse divider walls and one end of each of said raised platforms and a shorter transverse divider wall extends transversely between opposed facing ends of said adjacent spaced raised platforms;

said shorter transverse divider wall extending upwardly from said bottom wall terminating in a plane approximately flush with said top surface of each of said adjacent spaced raised platforms defining second generally rectangular recessed transverse troughs between respective opposed ends of each of said raised platforms.

8. The fastener storage and organizer tray according to claim 1, wherein said upstanding lateral divider walls at lateral sides of said raised platform top surface define a compartment having a width to accommodate the combined diameters of abutting shank portions of a number of adjacent alternating inverted side-by-side headed fasteners of a known size.

9. The fastener storage and organizer tray according to claim 1, wherein said tray has a number of said compartments, each having a said raised platform top surface and said transverse troughs, and a number of compartments without platforms and troughs for accommodating mating nuts, washers, and other fasteners and fittings.

10. The fastener storage and organizer tray according to claim 1, further comprising:

a cover member hingedly attached to said tray and having a latch mechanism for latching said cover member in a closed condition over said tray.

11. The fastener storage and organizer tray according to claim 1, wherein said tray is configured to be selectively stacked with a number of similar trays on top of another in a tool box or other container, or slidably supported in a cabinet.

12. The fastener storage and organizer tray according to claim 1, further comprising:

hand grip means at two opposed ends of said tray for lifting said tray or sliding it in and out of a cabinet.

13. The fastener storage and organizer tray according to claim 12, wherein said hand grip means comprises a cutout portion in said bottom wall at two opposed ends adjacent to a respective one of said upstanding peripheral side walls defining a handle at respective opposed ends of said tray.

14. The fastener storage and organizer tray according to claim 13, further comprising:

a cover member hingedly attached to said tray and having a latch mechanism for latching it in a closed condition over said tray;

said cover member having a cutout portion in a top wall at two opposed ends adjacent to said two opposed ends adjacent to said respective one of said upstanding peripheral walls, each of which is aligned with a respective said cutout portion in said tray bottom wall at two opposed ends in the closed condition to jointly form a handle for lifting the tray or sliding it in and out of a cabinet.

15. A method for storing, organizing, transporting and accessing a supply of headed fasteners and bolts of different bolt shank diameters, thread configuration and length, mating nuts, washers, screws, and other fasteners and fittings of different shapes and sizes, comprising the steps of:

providing a generally rectangular tray having a bottom wall bounded by upstanding peripheral side walls, and a plurality of individual compartments of different lengths and widths defined by upstanding longitudinal and transverse divider walls, at least one of said compartments having a generally rectangular raised platform with a top surface disposed horizontally in a plane a distance below top ends of said peripheral side walls and said divider walls, and a generally rectangular recessed trough at each of two opposed ends of said raised platform;

storing a number of headed fasteners on said raised platform top surface in laterally adjacent alternating inverted side-by-side relation with shank portions of said headed fasteners supported on said platform top surface, with a portion of the heads of alternate headed fasteners received in one said trough at one of said opposed ends of said raised platform and the end of said shank portions extending over said trough at the opposed end of said raised platform; and removing respective headed fasteners by pressing down on the end of the shank portion of a respective headed fastener to pivot it downward and raise the head of the respective headed fastener above one of said divider walls, and grasping the head of the respective headed fastener to remove it from a respective one of said compartments, or vice versa.

* * * * *